US008806664B1

(12) United States Patent
Judge et al.

(10) Patent No.: US 8,806,664 B1
(45) Date of Patent: Aug. 19, 2014

(54) CLOTHING GARMENT WITH COMBINATION HAT AND HOOD

(71) Applicants: Scott A. Judge, Northlake, IL (US); Frank A. Judge, Somonauk, IL (US)

(72) Inventors: Scott A. Judge, Northlake, IL (US); Frank A. Judge, Somonauk, IL (US)

( * ) Notice: Subject to any disclaimer, the term of this patent is extended or adjusted under 35 U.S.C. 154(b) by 0 days.

(21) Appl. No.: 13/730,951

(22) Filed: Dec. 29, 2012

(51) Int. Cl.
*A41D 3/08* (2006.01)

(52) U.S. Cl.
USPC ..... 2/84

(58) Field of Classification Search
USPC ..... 2/84–88, 93, 98, 202, 108, 69, 171.1, 2/209.11, 209.12, 209.13, 175.6, 195.4, 2/10
See application file for complete search history.

(56) References Cited

U.S. PATENT DOCUMENTS

| | | | | |
|---|---|---|---|---|
| 2,547,931 | A * | 4/1951 | De Grazia | 2/84 |
| 5,713,077 | A * | 2/1998 | Humbrecht | 2/173 |
| 7,302,710 | B2 * | 12/2007 | Thomas et al. | 2/84 |
| 7,380,286 | B1 * | 6/2008 | Bryant, Sr. | 2/84 |
| 8,438,665 | B2 * | 5/2013 | Roemer et al. | 2/84 |

* cited by examiner

*Primary Examiner* — Tejash Patel
(74) *Attorney, Agent, or Firm* — Kelly & Krause, L.P.; W. Dennis Drehkoff

(57) ABSTRACT

A garment comprising a cover having a lower edge attached substantially to the circumference of a neck of the garment and an upper edge that is attached to a hat. The cover having an opening for the wearer's face has a secure fitting around the wearer's head when the hat is worn by the wearer, thereby preventing wind and cold from reaching the wearer's neck and sides of the face and head and improving the wearer's peripheral vision.

15 Claims, 3 Drawing Sheets

CLOTHING GARMENT WITH COMBINATION HAT AND HOOD

BACKGROUND

1. Field of the Invention

The present invention relates to the field of hooded garments, and particularly to a garment having and integrated hood and hat combined therein.

2. Brief Description of the Prior Art

Various outdoor clothing worn in cool or cold weather may have hoods attached onto the garment for protecting the wearer's head, neck and face from the elements. The outdoor apparel may be jackets, coats, sweaters and sweatshirts. The hood may be sewn into the garment around the neck opening or may be removable. This allows the user to cover the head and neck when exposed to the elements or remove the hood when not needed.

Some individuals wear hats for keeping warm, for example, stretch hats, hats with bills, hats with ear coverings, etc. The hats are worn as a preference, but in some instances, hats may be required, for example, hats with bills for blocking the sun or hardhats required to be worn in construction areas for protection. Some wear hats and hooded clothing. In this regard, the hat usually interferes with the fitting of the hood around the wearer's head, neck and face. FIG. 1 shows a representation of hardhat on an individual with a hood covering the head, neck and sides of the face. The hat causes gaps of the hood on either side of the face because of its placement on the top of the hood. The gaps allow wind to enter the sides of the face and move around the wearer's neck and head obviating any warmness created by the hood. The gaps may require the wearing of additional face and neck warming articles, for example, face masks, scarfs, turtlenecks and other garments. The wearing of additional garments may be uncomfortable, inconvenient and unsafe when worn in construction areas. There is a need for a garment with a combined hat and hood wherein the wearer has benefits of wearing the hat and hood with in a warm, secure manner.

BRIEF SUMMARY OF THE INVENTION

One embodiment of the present invention is a garment comprising a body having a neck opening and sleeves that fits over the torso and head of the wearer. A cover having a lower edge and circumference in which a substantial portion of the circumference is attached to the neck of the garment. The cover has an opening for the wearer's head, face and an upper edge. The upper edge of the cover is attached to a head covering. The cover has a sufficient height to wrap around or cover the wearer's neck, sides of the face and sides of the head but no the top of the head. A head covering is attached to the upper edge of the cover and covers the top of the wearer's head. The head covering may be attached by sewing onto the cover, by fastener connectors and by hook and loop connectors, etc. The head covering may be a hat that is stretchable, for example a knit hat, a billed hat, for example a baseball hat or a hard hat for wearing in construction areas. The cover with the attached head covering is more comfortable to wear than a hood and with hat placed on top of the hood. The embodiment of the present invention provides a cover dimensioned so that there is no bunching or clumping of it when a head covering is attached to it and the hat is placed on top of the wearer's head. Further, the cover allows for better peripheral vision since the sides of a hood are not bunched on the sides of the wearer's face blocking peripheral vision. The hat can be removed and, since it is attached to the cover, hangs on the cover against the wearer's shoulders and back of the wearer's neck behind the head.

Another embodiment of the present invention is a combination hood and hat wherein a lower edge of a lower partial hood is connected to a neck opening of a garment, the lower partial hood also having an upper edge, an upper partial hood is connected to the upper edge of the lower partial hood, wherein the upper partial hood is a hat. The combined hood and hat garment has advantages for the wearer over that of a completed hood covering the head and hat placed on top.

DETAILED DESCRIPTION

Figure 1:
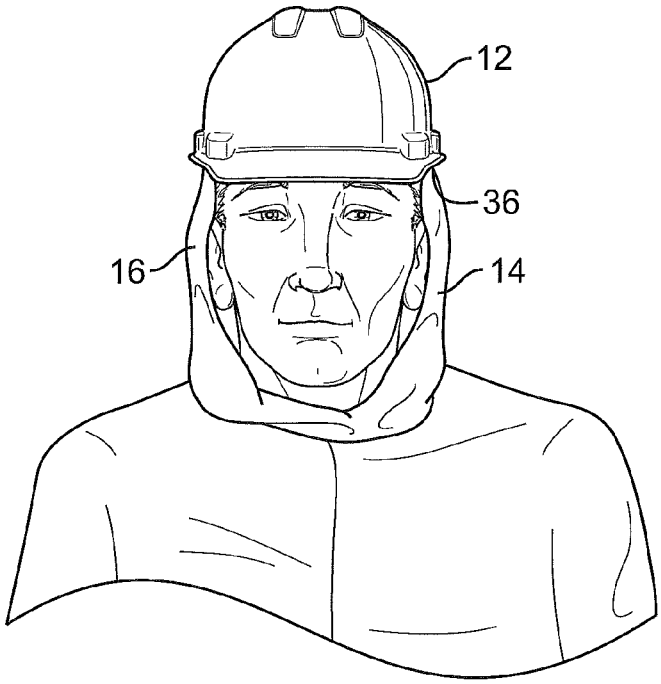
FIG. 1 (Prior Art)
FIG. 1. is a front view of a prior art garment with a hat being worn on the top of a hood by the wearer showing gaps on the sides of the hood adjacent the wearer's face.

FIG. 1 illustrates a side view of a prior art hooded sweatshirt with the wearer with a hard hat 12 positioned on his head. Hard hat 12 causes an uneven fit and gaps or bunching of sides 14 of hood 16 on the sides 18 of the wearer's face. This allows wind and cold air to move around the wearer's neck and head which may cause the wearer to wear additional protection in cold weather, a scarf, face cover, etc.

Figure 2:
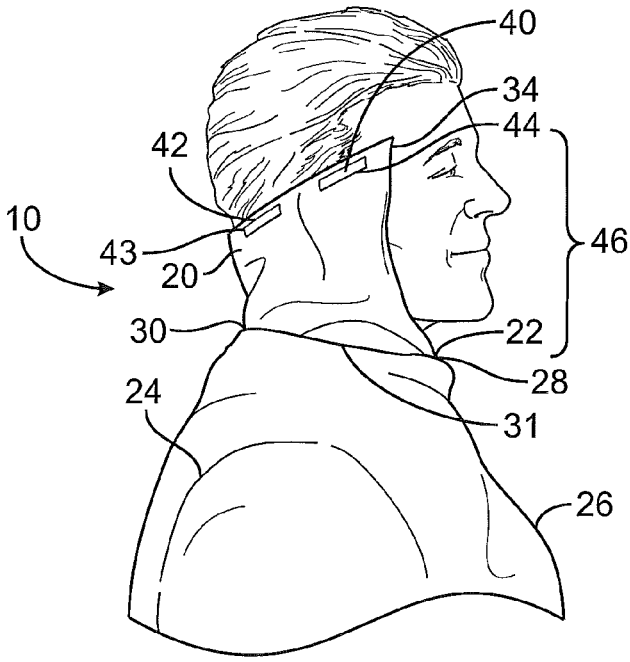
FIG. 2 illustrates a side view of one embodiment of the invention showing a cover having sufficient height to substantially cover the wearer's neck, both sides of the face and head.

FIG. 2 shows cover 20 attached to neck 22 of garment 10 having arms 24 and body 26 that fit over the torso of the wearer. Cover 20 has a lower edge 28 and circumference 30 wherein a substantial portion 31 of circumference 30 being attached to neck 22. Cover 20 has opening 32 for the wearer's face and upper edge 34 for attaching head cover 36, generally shown as a knit hat 38 in FIG. 3, in one preferred embodiment. Cover 20 has sides 23 and 25 that fit close to the sides of the wearer's face. Head cover 36 is attached to cover 20 by any suitable connector 40 that may be sewn onto cover 20, the upper edge 34 or attached to connectors 42 which may be snap fasteners 43 or hook and loop fasteners 44. Corresponding connectors are placed in the appropriate locations on the head cover 36 (not shown). Cover 20 has a sufficient height 46 to substantially cover the wearer's neck, both sides of the face and sides of the head of the wearer.

Figure 3:
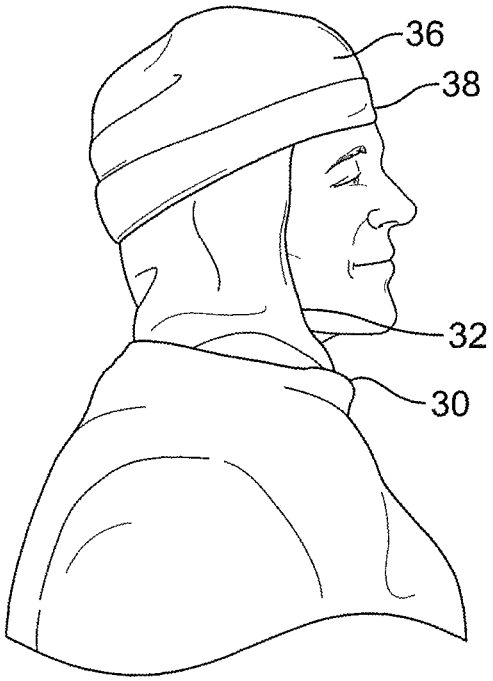
FIG. 3 illustrates a side view of a one embodiment of the invention showing a knit hat attached to the cover shown in FIG. 2 and worn on a wearer's head.

With respect to FIG. 3, knit hat 38 is shown in a side view on the wearer's head. Knit hat 38 is attached to upper edge 34 of cover 20 by hook and loop fasteners 44, (not shown). Knit hat 38 fits closely to the wearer's head offering warmth and protection from wind.

Figure 4:
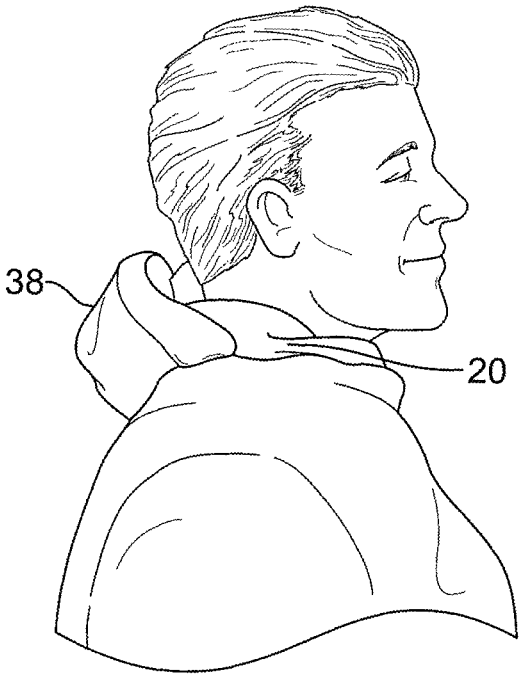
FIG. 4 illustrates a side view of one embodiment of the invention showing the knit hat shown in FIG. 3 off of the wearer's head and folded behind the wear's next white attached to the neck of the garment.
Figure 5:
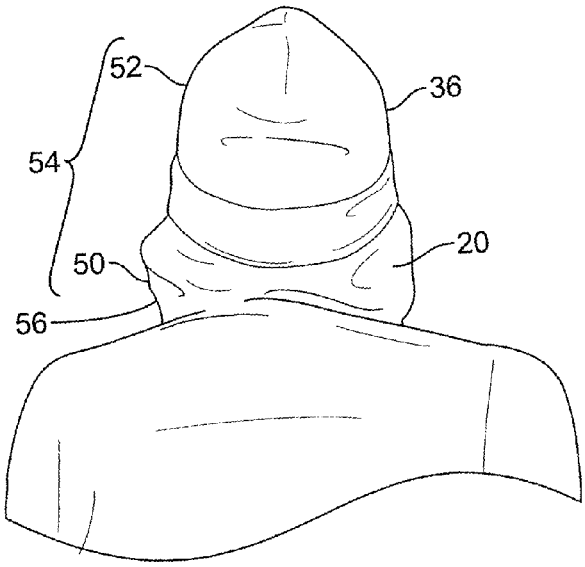
FIG. 5 illustrates a back view of one embodiment of the invention showing the knit hat shown in FIG. 3 on the wearer's head attached to the cover.

FIGS. 4 and 5 show knit hat 38 off of the wearer's head and retracted onto the wearer's back when it is not in use and a rearview of knit hat 38 being worn on the wearer's head.

Figure 6:
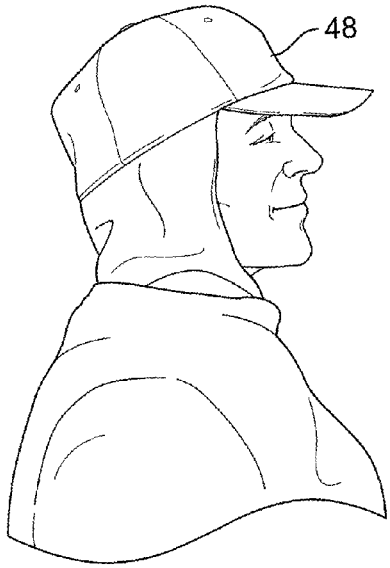
FIG. 6 illustrates a side view of one embodiment of the invention showing a baseball hat attached to the cover shown in FIG. 2 and on the wearer's head.

FIG. 6 is a side view of billed hat 48 attached to cover 20 on the wearer's head. Billed hat 48 fits securely on the wearer's head while sides 23 and 25 of cover 20 fit securely around the wearer's face.

Figure 7:
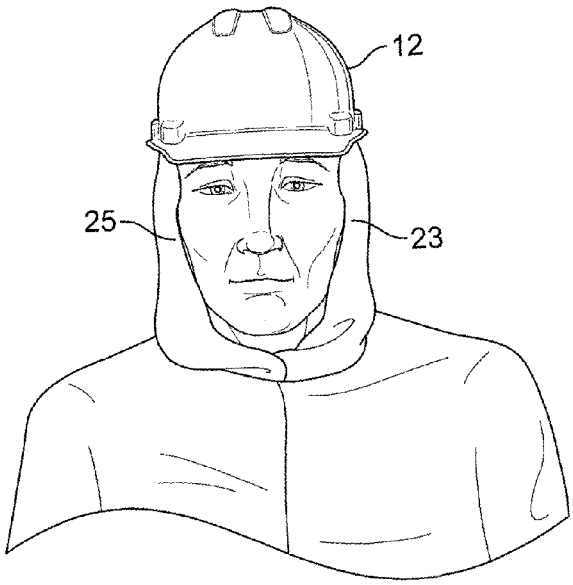
FIG. 7 shows a front view of one embodiment of the invention wherein a hard hat is worn by a wearer resulting in no gaps or bunching of the cover.

FIG. 7 is a front view of hardhat 12 on a wearer's head wherein hardhat 12 is secured to cover 20 by snap fasteners 42. The sides 23 and 25 of cover 20 fit smoothly and accurately adjacent to the sides of wearer's face. Sides 23 and 25 allow for improved peripheral vision when compared to a wearer using a hood.

Cover 20 is oriented to extend between a retracted position as shown in FIG. 4 and an extended position as shown in FIG. 5.

Conventional methods are utilized for patterning and construction the body of the garment.

In another embodiment cover 20 can be envisioned as a lower partial hood 50 with head cover 36 being envisioned as an upper partial hood 52, and when joined, forming hood 54. Thus, forming a hooded garment 56 containing a hat integrated into hood 54.

The present invention has been described in terms of specific embodiments incorporating details to facilitate understanding the principles of the construction and operations of the invention. Such reference herein to specific embodiments and details thereof is not intended to limit the scope of the claims appended hereto. It will be apparent to those skilled in the art that modifications may be made in the embodiment chosen for illustration without departing from the spirit and scope of the invention.

What is claimed is:

1. A garment comprising:

a garment body having a neck opening and sleeves;

a cover having a lower edge and circumference, a substantial portion of the circumference being attached to the neck opening of the garment, the cover having an opening for the wearer's face, exposing the wearer's chin when a head covering is worn and an upper edge that substantially covers the wearer's neck, sides of the head and both sides of the wearer's face to substantially eliminate gapping of the garment on the sides of the wearer's face, and the head covering attached to the upper edge.

2. The garment according to claim 1 wherein the cover has a sufficient height to substantially cover the wearer's neck, both sides of face and sides of the head.

3. The garment according to claim 1 wherein the head covering is attached to the upper edge of the cover by suitable connectors.

4. The garment according to claim 3 wherein the head covering is attached by sewing the head cover to the garment.

5. The garment according to claim 3 wherein the head covering is attached to the garment by snap fasteners.

6. The garment according to claim 3 wherein the head covering is attached to the garment by hook and loop fasteners.

7. The garment according to claim 1 wherein the head covering is a knit hat.

8. The garment according to claim 1 wherein the head covering is a billed hat.

9. The garment according to claim 1 wherein the head covering is a hard hat.

10. A garment with a combined hood and hat comprising:

a garment having a neck opening and sleeves;

a cover having a lower partial hood, having an upper edge defining an opening and lower edge and circumference, the circumference being substantially attached to the neck of the garment, and, an upper partial hood, in the form of a hat, attached to the upper edge of the lower partial hood, covering the opening defined by the upper edge of the partial hood and covering the top of the wearer's head, both the upper and lower partial hoods defining an opening for the wearer's face and chin and substantially eliminates gapping of the garment on the sides of the wearer's face when worn.

11. The garment according to claim 10 wherein the lower partial hood has sufficient height to substantially cover the wearer's neck, both sides of face and head.

12. The garment according to claim 10 wherein the-lower partial hood and upper partial hood are connected by any suitable connectors.

13. The garment according to claim 10 wherein the lower partial hood and upper partial hood are connected by sewing.

14. The garment according to claim 10 wherein the lower partial hood and upper partial hood are connected by snap fasteners.

15. The garment according to claim wherein the lower partial hood and upper partial hood are connected by hook and loop fasteners.

* * * * *